United States Patent [19]

Rosenberg

[11] Patent Number: 4,545,870

[45] Date of Patent: Oct. 8, 1985

[54] AQUEOUS ACID PLATING BATH AND BRIGHTENER COMPOSITION FOR PRODUCING BRIGHT ELECTRODEPOSITS OF TIN

[75] Inventor: William E. Rosenberg, Strongsville, Ohio

[73] Assignee: Columbia Chemical Corporation, Macedonia, Ohio

[21] Appl. No.: 644,391

[22] Filed: Aug. 27, 1984

[51] Int. Cl.[4] ..... C25D 3/32

[52] U.S. Cl. ..... 204/54 R; 204/DIG. 2; 252/182

[58] Field of Search ..... 204/54 R, 44.4, DIG. 2; 252/182

[56] References Cited

U.S. PATENT DOCUMENTS 4,072,582 2/1978 Rosenberg ..... 204/54 R

*Primary Examiner*—Howard S. Williams

*Attorney, Agent, or Firm*—Oldham, Oldham & Weber Co.

[57] ABSTRACT

A tin brightener for an electroplating bath contains various trialkoxybenzaldehydes for producing uniform desposits over a very broad current density range.

25 Claims, No Drawings

AQUEOUS ACID PLATING BATH AND BRIGHTENER COMPOSITION FOR PRODUCING BRIGHT ELECTRODEPOSITS OF TIN

TECHNICAL FIELD

The present invention relates to an aqueous acid electroplating bath for producing bright electrodeposits of tin. More specifically, the present invention relates to a brightening composition utilizing trialkoxybenzaldehydes which produces uniform deposits over a very broad current density range.

BACKGROUND ART

Plating baths and plating additives heretofore utilized include those set forth in U.S. Pat. No. 3,755,096 to Passal; U.S. Pat. No. 3,875,029 to Rosenberg et al; U.S. Pat. No. 3,977,949 to Rosenberg; U.S. Pat. No. 4,061,547 to Rosenberg; and U.S. Pat. No. 4,072,582 to Rosenberg. However, none of these plating baths or tin brighteners are pertinent since they do not teach or suggest the additives of the present invention.

DISCLOSURE OF INVENTION

Accordingly, it is an aspect of the present invention to provide a brightening composition which produces uniform semibright to bright electrodeposits of tin.

It is another aspect of the present invention to provide a brightener composition, as above, wherein the brightening agent is a trialkoxybenzaldehyde as a brightening agent which with acrylic acid and methacrylic acid, give uniform semibright to bright electrodeposits of tin over a broad current density range.

It is a further aspect of the present invention to provide a tin plating bath, as above, wherein emulsifiers are utilized to disperse the brightening agent.

These and other aspects of the present invention will become apparent from the detailed specification.

In general, a tin plating composition comprises from about 0.2 to about 20 percent by weight of a primary tin brightener, said primary brightener selected from the group consisting of trialkoxybenzaldehydes having the following general formula:

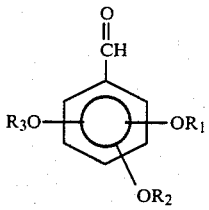

where $R_1$, $R_2$, and $R_3$ are the same or different and are methyl, ethyl, propyl, or isopropyl groups and from 1 to about 97 percent by weight of an organic acid.

An aqueous acid electroplating bath containing stannous ions and sulfuric acid for producing electrodeposits of tin, comprises: from about 0.005 to about 0.5 grams per liter of bath solution of a primary brightener, said primary brightener being a compound selected from the group consisting of trialkoxybenzaldehydes having the following general formula:

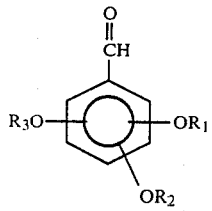

where $R_1$, $R_2$, and $R_3$ can be the same or different and are methyl, ethyl, propyl, or isopropyl groups.

BEST MODE FOR CARRYING OUT THE INVENTION

According to the concepts of the present invention it has been found that uniform semibright to bright electrodeposits can be obtained from an aqueous acid tin plating bath when certain trialkoxybenzaldehydes are used as primary brighteners. These trialkoxybenzaldehydes have the following general formula:

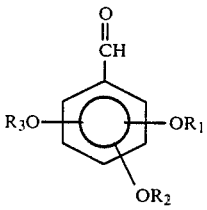

where $R_1$, $R_2$, and $R_3$ are all the same or different and can be methyl, ethyl, propyl, or isopropyl groups. It is preferred that $R_1$, $R_2$, and $R_3$ all be methyl groups. More specifically, the preferred primary brighteners are 2,3,4-trimethoxybenzaldehyde, 2,4,5-trimethoxybenzaldehyde, 2,4,6-trimethoxybenzaldehyde, 2,3,5-trimethoxybenzaldehyde, and 3,4,5-trimethoxybenzaldehyde.

Since the brighteners exhibit limited solubility in the plating bath, they are generally added to the plating bath by first being dissolved in a brightener solution. The brightener solution generally contains the primary brightener, a solvent, an emulsifying agent, and an organic acid such as acrylic acid or methacrylic acid. The amount of primary brightener in the brightener solution generally ranges from about 0.2 to about 20 percent by weight. In the plating bath, the amount of primary brightener generally ranges from about 0.005 grams to about 0.5 grams per liter of plating bath.

The emulsifying agents used to help disperse the primary brighteners are present in the brightener solution at a concentration of from about 1 percent to about 96 percent by weight, and preferably from about 20 percent to about 50 percent by weight based on the total weight of the mixture. The types of emulsifying agents can be anionic, nonionic, cationic, amphoteric, and mixtures thereof. They are used in the plating bath in a concentration of from about 2 to about 40 grams per liter, desirably from about 2 to about 10 grams, with an optimum amount being from about 3 to about 5 grams per liter.

The preferred emulsifying agents have been found to be the nonionics and modified nonionics. By modified nonionic, it is meant a polyethoxylated compound to which has been added one or more cationic groups, one or more anionic groups, or both. The nonionic emulsifying agents are generally made by condensing ethylene oxide with lipophilic groups such as long chain fatty alcohols, long chain fatty amines, long chain fatty acids, and long chain alkyl phenols, the long chain containing from 2 to about 30 carbon atoms, and preferably from 6 to 15 carbon atoms. The optimum amount of ethylene oxide is about 10 to 30 moles per lipophile. While the nonionics are highly preferred, it is not meant to limit the invention to these types only. For example, ethylene oxide derivatives of naphthols and polysaccarides also perform satisfactorily. In addition, propylene oxide condensates and ethylene oxide-propylene oxide block copolymers are also considered part of the present invention. The modified nonionic emulsifying agents have increased solubility in the plating bath.

Some of the commercially available emulsifying agents of this invention are Sufonic N-150 made by Texaco Chemical Co., Tergitol TMN made by Union Carbide Corp., Tetronic 504 made by BASF Syandotte, Inc.; and Triton QS-15 made by Rohm and Haas, Inc.

Acrylic acid and methacrylic acid are used in a concentration of from about 0.02 to about 5 grams per liter, preferably from about 0.02 to about 1.0 grams per liter of bath to act with the primary brighteners of this invention in producing bright deposits of tin that are extremely uniform. They may also be a part of a brightener solution or composition containing the primary brightener and from about 1 to about 97 percent by weight, desirably 5 to 30 percent by weight, of the acrylic acid or methacrylic acid. Of course, the emulsifying agent may also be added to this composition wherein the amount of emulsifying agent range is the same as set forth above. A preferred composition or solution of the present invention contains all four components—primary brightener, acrylic or methacrylic acid, an emulsifying agent and even a suitable solvent such as water, methyl, alcohol, ethyl alcohol, or a glycol ether. The amount of solvent can range from about 1 to about 80 percent by weight.

It has also been found that additional brightness can be obtained by the addition of from about 0.01 to about 0.5 grams per liter of bath of at least one aromatic aldehyde compound such as 2-chlorobenzaldehyde, 2,6-dichlorobenzaldehyde, 2,4-dichlorobenzaldehyde, and 2-hydroxy-1-naphthaldehyde. Generally, from about 0.2 to about 20 percent by weight of these aldehydes may be added to the brightener solution.

While the brightening compositions or solutions of this invention are effective in many aqueous acid tin plating bath formulations, it is preferred to use any of the basic baths described in the following examples. In general a source of stannous ions such as stannous sulfate is present. A suitable amount is from about 10 to about 100 grams per liter. Also present is sulfuric acid in a concentration of from about 50 to 260 grams per liter.

The plating baths used in the following examples all contained 180 grams of sulfuric acid per liter and 30 grams of stannous sulfate per liter.

| EXAMPLE I | |
|---|---|
| Tergitol TMN-10 (Linear alcohol polyethoxylate) | 2.5 gms./liter |
| Methacrylic Acid | 0.6 gms./liter |
| 2,3,4-trimethoxybenzaldehyde | 0.004 gms./liter |
| **EXAMPLE II** | |
| Surfonic N-150 (Nonylphenol polyethoxylate) | 4 gms./liter |
| Methacrylic Acid | 0.6 gms./liter |
| 2,4,5-trimethoxybenzaldehyde | 0.02 gms./liter |
| **EXAMPLE III** | |
| Surfonic N-150 (Nonylphenol polyethoxylate) | 4 gms./liter |
| Acrylic Acid | 0.04 gms./liter |
| 3,4,5-trimethoxybenzaldehyde | 0.02 gms./liter |
| **EXAMPLE IV** | |
| Ethoxylated Beta-Naphthol (12 moles ethylene oxide) | 7.5 gms./liter |
| Methacrylic Acid | 1 gm./liter |
| 2,4,6-trimethoxybenzaldehyde | 0.02 gms./liter |

TABLE I

| Results From Plating Tests | |
|---|---|
| Test 1 | |
| The plating bath of Example I | Semibright deposit from 0 to about 6 amps/sq. ft. Bright deposit from about 6 to well over 150 amps/sq. ft. |
| Test 2 | |
| The plating bath of Example II | Semibright deposit from 0 to about 8 amps/sq. ft. Bright deposit from about 8 to well over 150 amps/sq. ft. |
| Test 3 | |
| The plating bath of Example III | Semibright deposit from 0 to about 6 amps/sq. ft. Bright deposit from 6 to about 100 amps/sq. ft. |
| Test 4 | |
| The Plating bath of Example IV | Bright deposit from about 2 to well over 150 amps/sq. ft. |

As a control, the plating bath of Example 1 was prepared but with no 2,3,4-trimethoxybenzaldehyde, therein. When utilized in a plating test, dull coarse deposits were obtained from 0 to well over 150 amps/sq. ft.

Having thus described this invention in such full, clear and concise, and exact terms as to enable any person skilled in the art to which it pertains to make and use the same, and having set forth the best mode contemplated of carrying out this invention, in accordance with the patent statutes, the subject matter which is regarded as being my invention is particularly pointed out and distinctly claimed in the appended claims.

What is claimed:

1. A tin plating brightening composition, comprising; from about 0.2 to about 20 percent by weight of a primary tin brightener, said primary brightener selected from the group consisting of trialkoxybenzaldehydes having the following general formula:

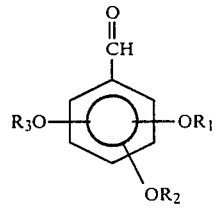

where $R_1$, $R_2$, and $R_3$ are the same or different and are methyl, ethyl, propyl, or isopropyl groups and from 1 to about 97 percent by weight of an organic acid.

2. The tin plating brightening composition according to claim 1, including from about 1 to about 96 percent by weight of at least one emulsifying agent selected from the group consisting of nonionic, modified nonionic, cationic, anionic, and amphoteric emulsifying agent, and combinations thereof, and wherein said organic acid is selected from the group consisting of acrylic acid and methacrylic acid, and combinations thereof.

3. The tin plating brightening composition according to claim 2, including from about 1 to about 80 percent by weight of a solvent.

4. The tin plating brightening composition according to claim 2, wherein said emulsifying agent is selected from the group consisting of a nonionic, and a modified nonionic.

5. The tin plating brightening composition according to claim 4 wherein said acid is methacrylic acid, wherein the amount of said methacylic acid is from about 5 to about 30 percent by weight, and wherein the amount of said emulsifying agent is from about 20 to about 50 percent by weight.

6. The tin plating brightening composition according to claim 5, wherein the primary brightener is a trimethoxybenzaldehyde.

7. The tin plating brightening composition according to claim 6, wherein the primary brightener is 2,3,4-trimethoxybenzaldehyde.

8. The tin plating brightening composition according to claim 6, wherein the primary brightener is 2,4,5-trimethoxybenzaldehyde.

9. The tin plating brightener composition according to claim 6, wherein the primary brightener is 2,4,6-trimethoxybenzaldehyde.

10. The tin plating brightening composition according to claim 6, wherein the primary brightener is 3,4,5-trimethoxybenzaldehyde.

11. The tin plating brightening composition according to claim 6, wherein the primary brightener is 2,3,5-trimethoxybenzaldehyde.

12. The tin plating brightening composition according to claim 6, wherein there is also present from about 0.2 to about 20 percent by weight of at least one compound selected from the group consisting of o-chlorobenzaldehyde, 2,6-dichlorobenzaldehyde, 2,4-dichlorobenzaldehyde, and 2-hydroxy-1-naphthaldehyde.

13. An aqueous acid electroplating bath containing stannous ions and sulfuric acid for producing electrodeposits of tin, comprising:

from about 0.005 to about 0.5 grams per liter of bath solution of a primary brightener, said primary brightener being a compound selected from the group consisting of trialkoxybenzaldehydes having the following general formula:

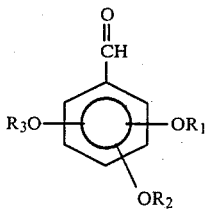

where $R_1$, $R_2$, and $R_3$ can be the same or different and are methyl, ethyl, propyl, or isopropyl groups.

14. An aqueous acid electroplating bath according to claim 13, wherein the amount of the stannous ions is from about 10 grams to about 100 grams per liter of bath solution and wherein the amount of sulfuric acid is from about 50 to about 260 grams per liter of said bath solution.

15. The bath according to claim 13, including from about 2 to about 40 grams per liter of an emulsifying agent, said emulsifying agent is selected from the group consisting of nonionic, modified nonionic, anionic, cationic, and amphoteric emulsifying agents, and combinations thereof.

16. The bath according to claim 15, including from about 0.02 to about 5 grams per liter of a compound selected from the group consisting of acrylic acid, methacrylic acid, and combinations thereof.

17. The bath according to claim 16, wherein said emulsifying agent is selected from the group consisting of a nonionic and a modified nonionic emulsifying agent.

18. The bath according to claim 17, wherein said acid is methacrylic acid, wherein the amount of said methacrylic acid is from about 0.02 to about 1.0 grams per liter and wherein the amount of said emulsifying agent is from about 2 to about 10 grams per liter.

19. The bath according to claim 18, wherein the primary brightener is a trimethoxybenzaldehyde.

20. The bath according to claim 18, wherein the primary brightener is 2,3,4-trimethoxybenzaldehyde.

21. The bath according to claim 18, wherein the primary brightener is 2,4,5-trimethoxybenzaldehyde.

22. The bath according to claim 18, wherein the primary brightener is 2,4,6-trimethoxybenzaldehyde.

23. The bath according to claim 18, wherein the primary brightener is 2,3,5-trimethoxybenzaldehyde.

24. The bath according to claim 18, wherein the primary brightener is 3,4,5-trimethoxybenzaldehyde.

25. The bath according to claim 19, including from about 0.01 to about 0.5 grams per liter of bath of at least one compound selected from the group consisting of o-chlorobenzaldehyde, 2,6-dichlorobenzaldehyde, 2,4-dichlorobenzaldehyde, and 2-hydroxy-1-naphthaldehyde.

* * * * *